US011569580B2

(12) United States Patent
Dai

(10) Patent No.: US 11,569,580 B2
(45) Date of Patent: Jan. 31, 2023

(54) MULTILAYER GLASS PATCH ANTENNA

(71) Applicant: Pittsburgh Glass Works, LLC, Pittsburgh, PA (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 5 days.

(21) Appl. No.: 17/112,036

(22) Filed: Dec. 4, 2020

(65) Prior Publication Data

US 2021/0175628 A1 Jun. 10, 2021

Related U.S. Application Data

(60) Provisional application No. 62/944,669, filed on Dec. 6, 2019.

(51) Int. Cl.
*H01Q 1/32* (2006.01)
*H01Q 9/04* (2006.01)

(52) U.S. Cl.
CPC ..... *H01Q 9/045* (2013.01); *H01Q 1/325* (2013.01)

(58) Field of Classification Search
CPC ..... H01Q 9/045; H01Q 1/325; H01Q 1/2291; H01Q 1/38; H01Q 1/40; H01Q 9/0457; H01Q 1/1285
See application file for complete search history.

(56) References Cited

U.S. PATENT DOCUMENTS

| | | | | |
|---|---|---|---|---|
| 7,126,549 | B2 | 10/2006 | Li et al. | |
| 2005/0195114 | A1* | 9/2005 | Yegin | H01Q 1/1285 343/713 |
| 2006/0202898 | A1 | 9/2006 | Li et al. | |
| 2007/0216589 | A1* | 9/2007 | Li | H01Q 1/1271 343/711 |
| 2008/0024379 | A1 | 1/2008 | Urban et al. | |
| 2012/0256798 | A1 | 10/2012 | Paulus et al. | |
| 2014/0104122 | A1 | 4/2014 | Lee et al. | |
| 2017/0324138 | A1 | 11/2017 | Talty et al. | |
| 2018/0037007 | A1 | 2/2018 | Droste et al. | |

OTHER PUBLICATIONS

Tanveer, "Design of Aperture Coupled Micro-Strip Patch Antenna for Wireless Communication Applications at 10Ghz", International Journal of Electronics Engineering, 4 (1), 2012, pp. 25-28 (Year: 2012).*

* cited by examiner

*Primary Examiner* — Dieu Hien T Duong
(74) *Attorney, Agent, or Firm* — Dentons Cohen & Grigsby P.C.

(57) ABSTRACT

An antenna suitable for use in the 5 GHz WLAN/Wi-Fi and DSRC frequency band is integrated with a vehicle window that is includes outer and inner transparent plies bonded together by an interlayer. The inner transparent ply and the interlayer serve as an antenna substrate. A first conductive layer is formed on the inner surface of the outer transparent ply and a second conductive layer that defines a coupling slot is formed on the outer surface of the inner transparent ply. The antenna may be excited by a coaxial cable or a microstrip line that crosses the coupling slot.

18 Claims, 8 Drawing Sheets

| Parameters | Size (mm) | Description |
|---|---|---|
| $W_p$ | 11 | width of 1st conductive layer |
| $L_p$ | 8 | length of 1st conductive layer |
| $W_g$ | 38 | width of 2nd conductive layer |
| $L_g$ | 38 | length of 2nd conductive layer |
| $L_{s1}$ | 12 | slot length – part 1 |
| $L_{s2}$ | 3 | slot length – part 2 |
| $L_{s3}$ | 3 | slot length – part3 |
| $W_s$ | 1.5 | slot width |

MULTILAYER GLASS PATCH ANTENNA

RELATED APPLICATIONS

This application claims priority to U.S. Provisional patent Application No. 62/944,669 filed Dec. 6, 2019 entitled "Multilayer Glass Patch Antenna," which is incorporated herewith in its entirety.

TECHNICAL FIELD

The presently disclosed invention relates to a patch antenna and, more particularly, to a multilayer patch antenna that is embedded in a laminated window glass and receives and/or transmits electromagnetic signals for connected vehicle communications.

BACKGROUND OF THE INVENTION

In automotive glazings such as windshields and back windows, antennas for the reception and/or transmission of radio frequency waves such as AM, FM, TV, DAB, RKE, etc. are often carried on or incorporated in the glazing. Such antennas have been formed by printing conductive lines such as silver or copper onto a glazing transparency or by laminating metal wires or strips between transparency layers of the vehicle glazing. Such antennas offer advantages of aerodynamic performance for the vehicle as well as provide an aesthetically pleasing, streamline appearance for the vehicle.

In recent years, the automotive industry has developed vehicles that are capable of communicating via radio frequency signals and other communication channels. Such vehicles are sometimes referred to as "the connected car." New vehicle models offer a growing list of optional features such as safety improvements and features that enable Dedicated Short Range Communications (DSRC) radios for vehicle-to-vehicle (V2V) and vehicle-to-infrastructure (V2I) communications. Currently, the automotive industry is moving from assisted driving toward autonomous driving. Each new car connection, whether by cellular, WLAN or DSRC, requires an antenna that supports the respective communication channel. In some cases, as many as six antennas may be required for cellular service and another six DSRC antennas for V2V and V2I communications. Designing antennas that can be accommodated by space that is available on the vehicle presents a significant challenge. Integrating antennas in the vehicle glazings offers advantages of improved aesthetics, simplified antenna packaging, reduced weight, discouraging theft and vandalism, and eliminating holes in the vehicle body that are prone to water invasion and other problems. Therefore, there has been a need for antennas that are capable of operating at high frequencies (e.g. above 2 GHz) and that can be mounted on a vehicle without protruding from the exterior of the vehicle or into the interior passenger compartment.

US patent application US 2018/0037007 A1 illustrates a patch antenna that is attached to the interior surface of the inner pane of a laminated glass for Global Navigation Satellite System (GNSS) application. U.S. Pat. No. 7,126,549 B2 describes a patch antenna that is attached to the interior surface of the inner pane of a laminated glass for Satellite Digital Audio Radio Service (SDARS). Both of those patch antennas are attached to the inner surface of the transparency and provide a narrow band that is characteristic of patch antennas. Additionally, those designs require a relatively expensive low loss substrate material and, due to curvature of the vehicle glazing, the substrate may not be appropriately secured to the glazing. In addition, the antenna patch is printed on one of the inner surfaces of a transparency that is covered with black paint for aesthetic reasons. That design makes alignment of the antenna substrate and the patch more problematic for production in commercial quantities.

The rapid growth in connected vehicle communications has given rise to a need to integrate more and more antennas on the vehicle. There is, therefore, a need for DSRC, Wi-Fi, WLAN and Bluetooth antennas that can be mounted to a surface of the vehicle, but that do not extend from the exterior of the vehicle or protrude into the interior passenger compartment. In addition, there is a practical need that such antennas can be accommodated by existing vehicle parts as standard equipment with minimum cost. Still further, it is also important that such antennas maintain the aesthetic or appearance of the vehicle and require only limited modification to existing glazing structure and manufacturing processes. Furthermore, there is also need for a single antenna having wide band characteristics which can receive and transmit over the entire Wi-Fi and DSRC frequency band.

SUMMARY OF THE INVENTION

The presently disclosed invention discloses a slot coupled glass patch antenna suitable for 5 GHz WLAN/Wi-Fi, DSRC, V2V and V2I communications. The disclosed patch antenna is embedded into a laminated vehicle window glass with a plurality of antenna feed methods. The antenna has wide-band impedance matching and frequency tuning capability.

The laminated glazing includes an inner ply and an outer ply. Inner ply and outer ply are bonded together by an interposed layer, preferably of a standard polyvinyl butyral (PVB) or similar plastic material. Outer ply has an outer surface that defines the outside of glazing and an inner surface. Inner ply has an outer surface that faces internally on glazing and an inner surface that defines the inside of glazing and faces internally to the vehicle. The patch antenna includes a first conductive element and a second conductive element. The second conductive element is spaced from and substantially parallel to and overlapping the first conductive element. The first conductive element of the antenna is disposed on the inner surface of the outer ply and the second conductive element of the antenna is disposed on the inner surface of the inner ply.

The first conductive element is the radiating element of the patch antenna and the second conductive element is the ground plane of the patch antenna. The ground plane further includes an antenna coupling slot aligned and spaced from the radiation element to define an antenna feed region. If the coupling slot is excited by electromagnetic waves, then the field distribution in the slot can be constructed by a set of orthogonal modes. For a long thin slot, the amplitudes of electrical field of the modes have sine type periodicity of integer number of the slot length and it is possible to excite one set of these modes in preference to the others.

The patch antenna can be excited by a microstrip feed line. This antenna feed method requires a thin antenna feed substrate below the inner ply with a microstrip feed line etched on the bottom of the feed substrate. The patch antenna can also be fed by a coaxial cable with cable ground been connected to the ground plan near one side of the slot and the center conductor of the coaxial cable extended cross the slot and connecting to the other side of the slot. When direct fed by a coaxial cable the whole antenna is part of the glass with no additional antenna feed network required. In addition, the patch antenna can be embedded around the perimeter of window glass which offers more flexibility to package the antennas on the vehicle for reliable high-speed data communication.

BRIEF DESCRIPTION OF THE DRAWINGS

For a more complete understanding of the disclosed invention, reference should now be had to the embodiments illustrated in greater detail in the accompanying drawings and described below by way of examples of the invention wherein.

DETAILED DESCRIPTION OF THE INVENTION

Figure 1:
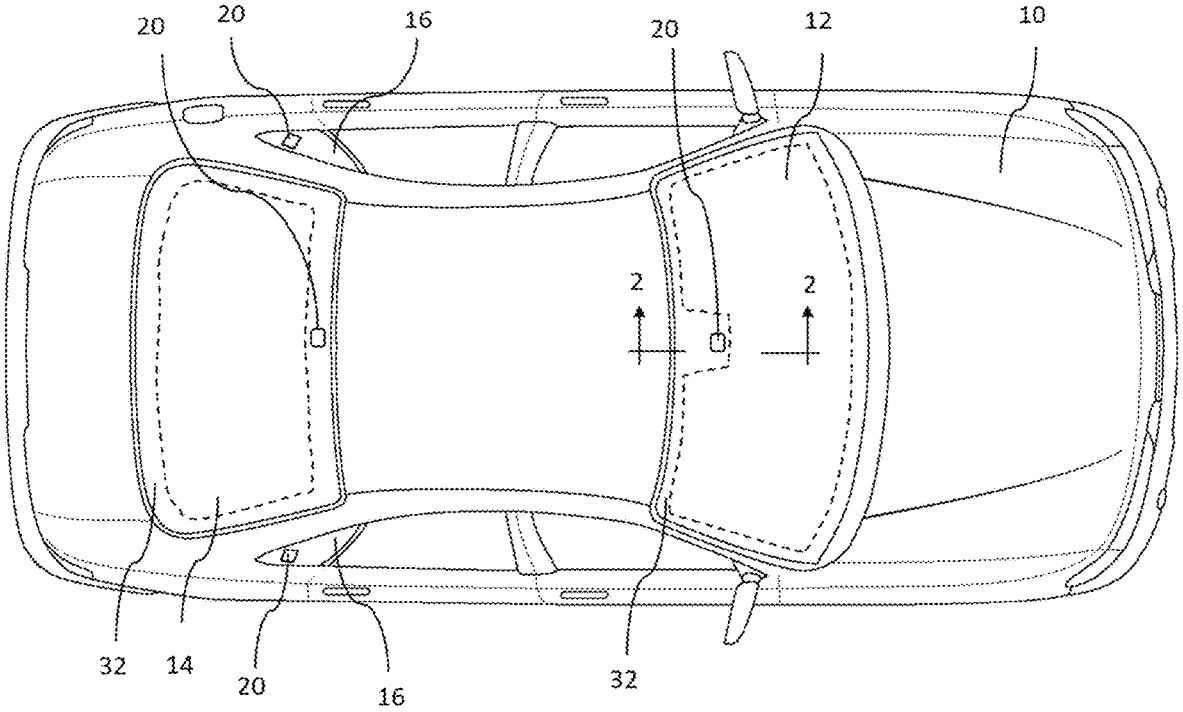
FIG. 1 is a plan view of a vehicle having an antenna that embodies the presently disclosed invention included in the windshield, backlite and side windows.

FIG. 1 illustrates a vehicle 10 having a windshield 12, a backlite 14, and two side window glazings 16. Windshield 12 and backlite 14 may include a concealment band 32 that is applied by screen printing opaque ink on the glazing and subsequently firing the perimeter of the window glass. The purpose of the concealment band 32 is to conceal the antenna elements and other apparatus that is located near the glass edge. An antenna 20 is formed in windshield 12, preferably within the silhouette of the concealment band 32 to minimize visibility of antenna 20. Although the presently preferred embodiment of FIG. 1 shows that antenna 20 is formed in windshield 12, it may also be located in backlite 14, a side glazing 16, or any other glazing or sunroof on vehicle 10. Antenna 20 also may be formed in non-vehicular windows such as buildings.

Figure 2:
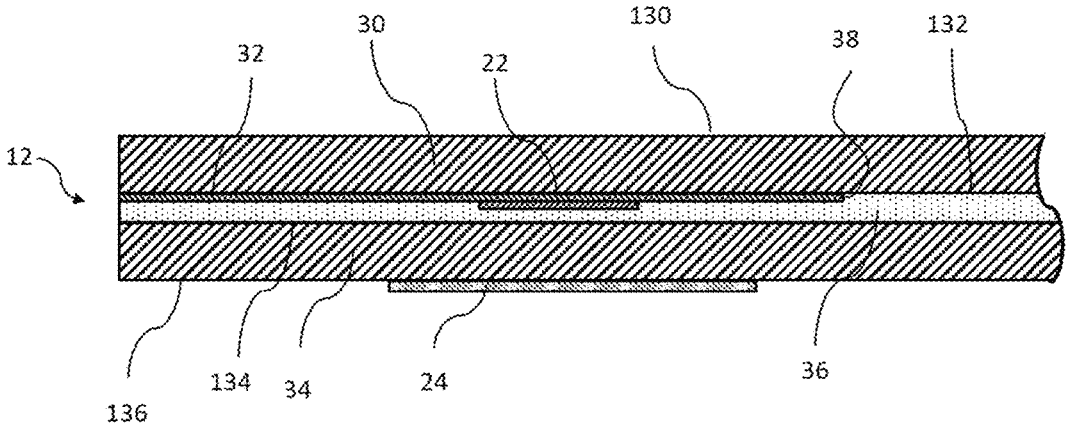
FIG. 2 is a partial cross-sectional view of a first embodiment of one of the antennas shown in FIG. 1 and taken along line 2-2 of FIG. 1.

FIG. 2 is a partial cross section view of antenna 20 in windshield 12 taken along line 2-2 in FIG. 1. Windshield 12 is a laminated glazing that includes inner transparent ply 34 and outer transparent ply 30. Transparent plies may be composed of glass. Inner ply 34 and outer ply 30 are bonded together by an interlayer layer 36. Preferably, interlayer 36 is made of a polyvinyl butyral or similar material. Outer ply 30 has an outer surface 130 (conventionally referred to as the number 1 surface) that defines the outside or outwardly facing surface of windshield 12. Outer ply also defines an inner surface 132 (conventionally referred to as the number 2 surface) that is oppositely disposed on outer ply 30 from outer surface 130. Inner ply 34 has an outer surface 134 (conventionally referred to as the number 3 surface) that faces away from the vehicle passenger compartment and faces internally in glazing 12 so that its opposite inner surface 132 of outer transparent ply 30. Inner transparent ply 34 also defines an inner surface 136 (conventionally referred to as the number 4 surface) that defines the inside or inwardly facing surface of glazing 12 such that it faces internally to the passenger compartment of the vehicle. Interlayer 36 is located between surfaces 132 and 134.

As shown in FIGS. 1 and 2, glazing 20 may include concealment band 32 such as a paint band that is applied to outer ply 30 by screen printing opaque ink around the perimeter of surface 132 of outer ply 30 and then firing the perimeter of the outer ply. Concealment band 32 has a closed inner edge 38 that defines the boundary of the daylight opening (DLO) of glazing 12. Concealment band 32 is sufficiently wide to cover the antenna elements of the disclosed windshield as well as other apparatus that is included near the outer perimeter of glazing 12 as hereinafter shown and described.

Glazing 12 further includes a first conductive layer 22 and a second conductive layer 24. First conductive layer 22 is disposed over concealment band 32 on surface 132 of outer ply 30 and second conductive layer 24 is disposed on surface 136 of inner ply 34. Second conductive layer 24 is substantially in parallel to and spaced away from first conductive layer 22. Interlayer 36 and inner ply 34 act as a dielectric substrate for first conductive layer 22 and second conductive layer 24.

First conductive layer 22 and second conductive layer 24 may be implemented in other ways that are further illustrated herein by way of example. Conductive layers 22 and 24 may be composed of conductive paint, metallic film deposited by sputtering or vapor deposition, and silver paste screen meshed to a nonconductive panel. Furthermore, conductive layers 22 and 24 may be formed on the surfaces of a single layer nonconductive pane such as a tempered glass window, or on the surfaces of any layer in a multilayer laminated transparency of glass or plastic layers. Conductive layers 22 and 24 also may be bonded to the surfaces of a non-conductive body panel, such as an interior or exterior fiberglass panel.

First conductive layer 22 sometimes may be referred to as a "patch." In the disclosed embodiment, the patch (conductive layer 22) is the main radiating element of the antenna. First conductive layer 22 may have any given profile shape such as, for example, rectangular, circular, triangular or elliptical. In the example of the disclosed embodiment, a rectangular profile shape is preferred. Second conductive layer 24 acts as an electrical ground plane. First conductive layer 22 cooperates with second conductive layer 24, interlayer 36 and inner ply 34 to define a patch antenna. Second conductive layer 24 further defines a slot 42. Slot 42 may have various profile shapes such as, for example, straight, L-shaped or U-shaped slot. Energy is electromagnetically coupled through slot 42 in the second conductive layer 24.

Figure 5:
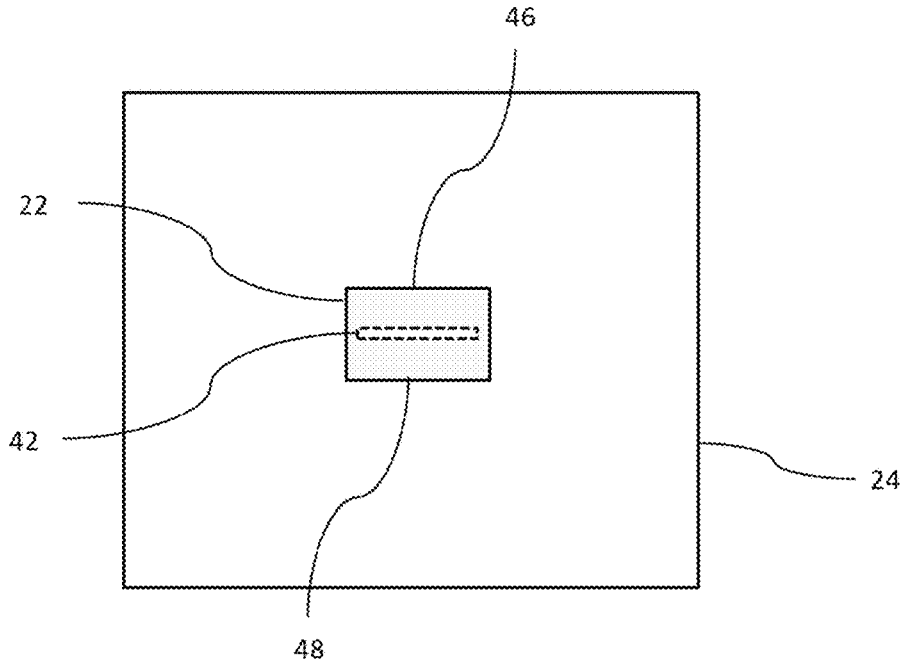
FIG. 5 is a top view of the patch antenna that is disclosed herein showing a first conductive layer and a second conductive layer, wherein the second conductive layer incudes a rectangular slot.

Slot 42 is preferably oriented in with respect to the center of first conductive layer 22 because that is the location of the maximum magnetic field of the patch antenna. To achieve maximum coupling, slot 42 is preferably parallel to the two radiating edges 46 and 48 of first conductive layer 22 as illustrated in FIG. 5. The disclosed patch antenna with electromagnetic coupling slot 42 is advantageous in that it avoids the need for a hole in windshield 12 for antenna feeding. The manufacture of vehicle glazings and other glass windows with holes involves difficulties in terms of cost, yield and reliability.

Figure 6:
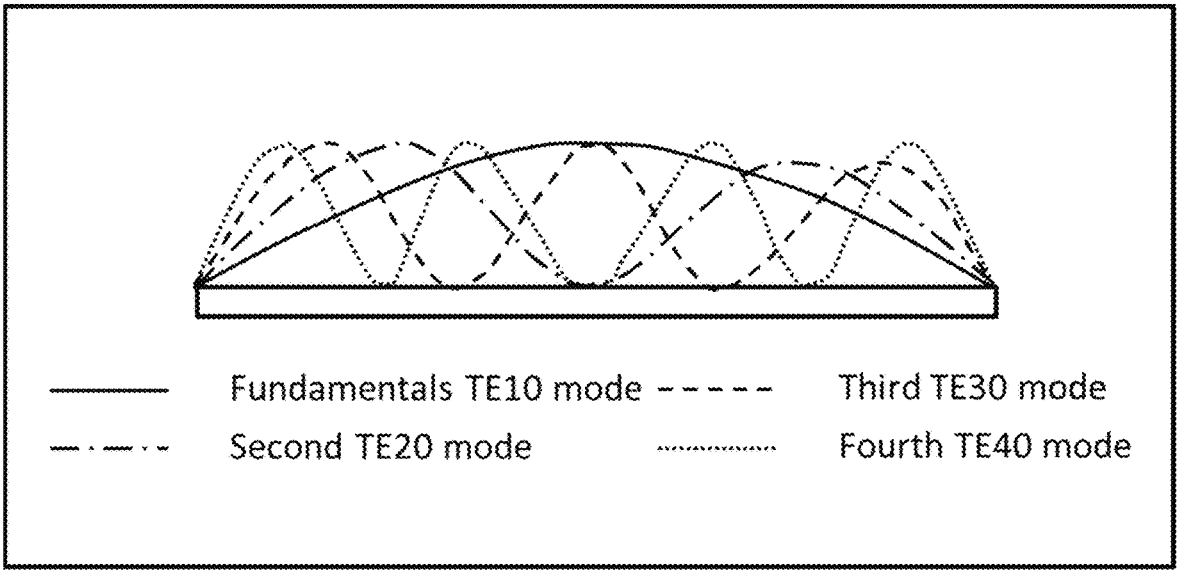
FIG. 6 illustrates the electrical field distribution in the slot in the second conductive layer.

When slot 42 is excited by electromagnetic waves, the electric field distribution in slot 42 can be described according to a set of orthogonal modes. When slot 42 is relatively long and narrow, the amplitudes of the electrical field of the modes have sine-type periodicity according to an integer multiple of the slot length as shown in FIG. 6 where the slot has a length equal to one-half wavelength at the fundamental TE10 frequency mode. For a relatively long, thin (i.e. narrow) slot, one set of these modes can be excited in preference to other modes. The frequency of operation is also of consequence. FIG. 6 illustrates that the amplitude of electric field distribution of the odd modes (namely, TE10 mode and TE30 mode) attain maximum value at the center of slot 42. Conversely, the even modes (namely, the TE20 mode and TE40 mode) attain minimum value at the center of slot 42. When slot 42 is excited in the middle, TE10 mode and TE30 mode are at maximum value and therefor afford strong coupling to these modes. At the same time, TE20 mode and TE40 mode are at minimum value so that coupling to these modes is near zero.

Figure 3:
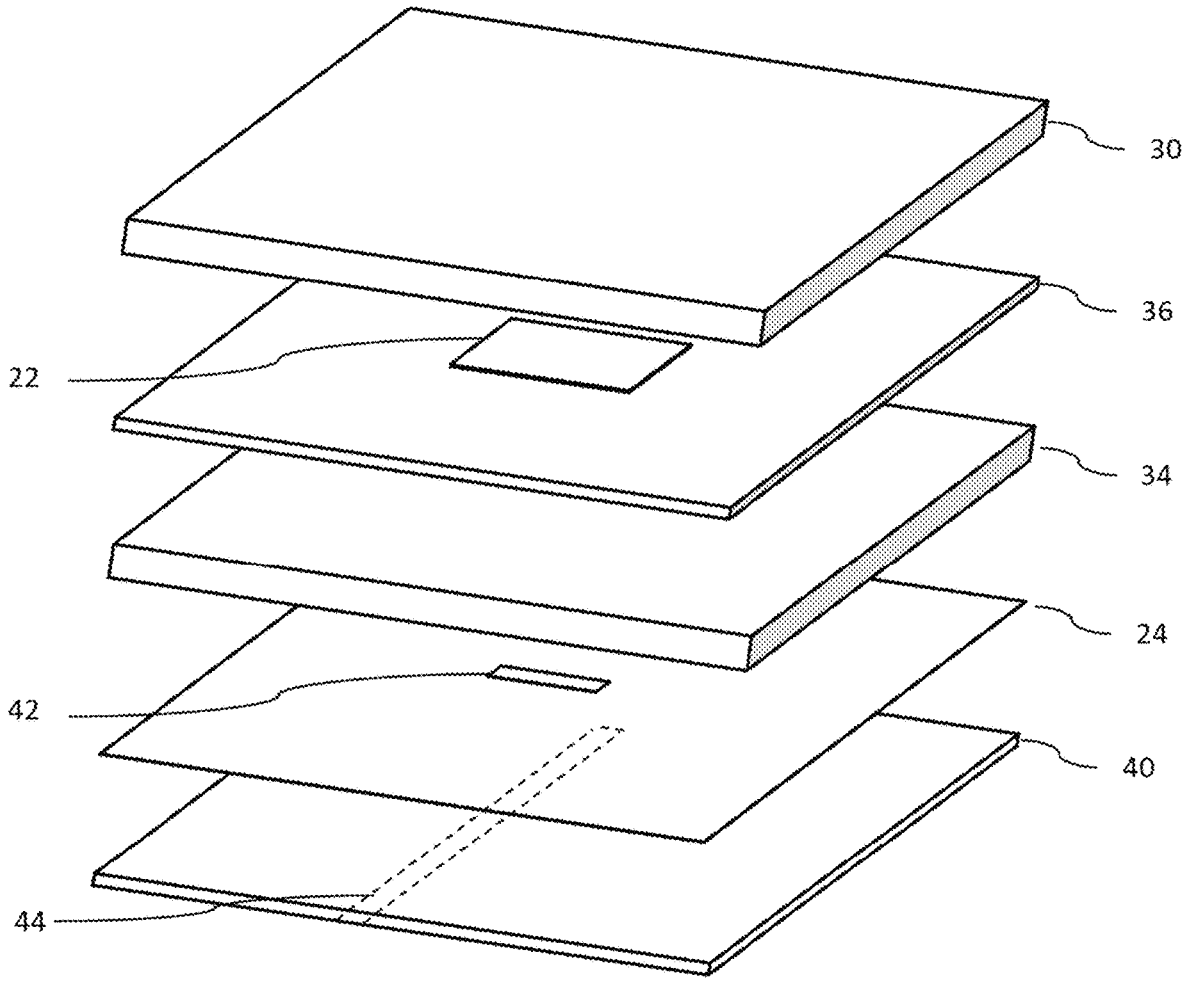
FIG. 3 is an exploded view of the embodiment of the patch antenna illustrated in FIGS. 1 and 2.

Referring to FIG. 3, the disclosed patch antenna is fed by a microstrip line 44 that is etched on the bottom of a thin substrate 40. The patch antenna is excited by two very similar coupling mechanisms, one coupling mechanism between microstrip line 44 and slot 42 and a second coupling mechanism between slot 42 and first conductive layer 22. The characteristic impedance of microstrip line 44 and the width of microstrip line 44 affect electromagnetic coupling to slot 42. For maximum coupling, microstrip line 44 is oriented to with respect to slot 42 such that the longitudinal dimension of microstrip line 44 is oriented at right angles to the longitudinal centerline of slot 42 which is defined as the midpoint between the long-side edges of slot 42. When microstrip line 44 is skewed away from right angle orientation (i.e. microstrip line 44 forms an oblique angle) with respect to the longitudinal centerline of slot 42 or when microstrip line 44 is located closer to one end of slot 42 (i.e. a width end of slot 42 formed between the longer sides) than the opposite end, coupling to the fundamental TE10 mode of the patch antenna is reduced.

The presently disclosed patch antenna includes an additional antenna feed substrate 40. Due to the curvature of plies 30 and 34 of windshield 12, windshield 12 may not readily accommodate antenna feed substrate 40. In addition, first conductive layer 22 is embedded inside windshield 12 and, for improved aesthetics, is often covered by concealment band 32 that makes that preferred alignment between microstrip line 44 and first conductive layer 22 more difficult. Therefore, other designs may sometimes be more preferred due to cost and facility of commercial fabrication.

Figure 4:
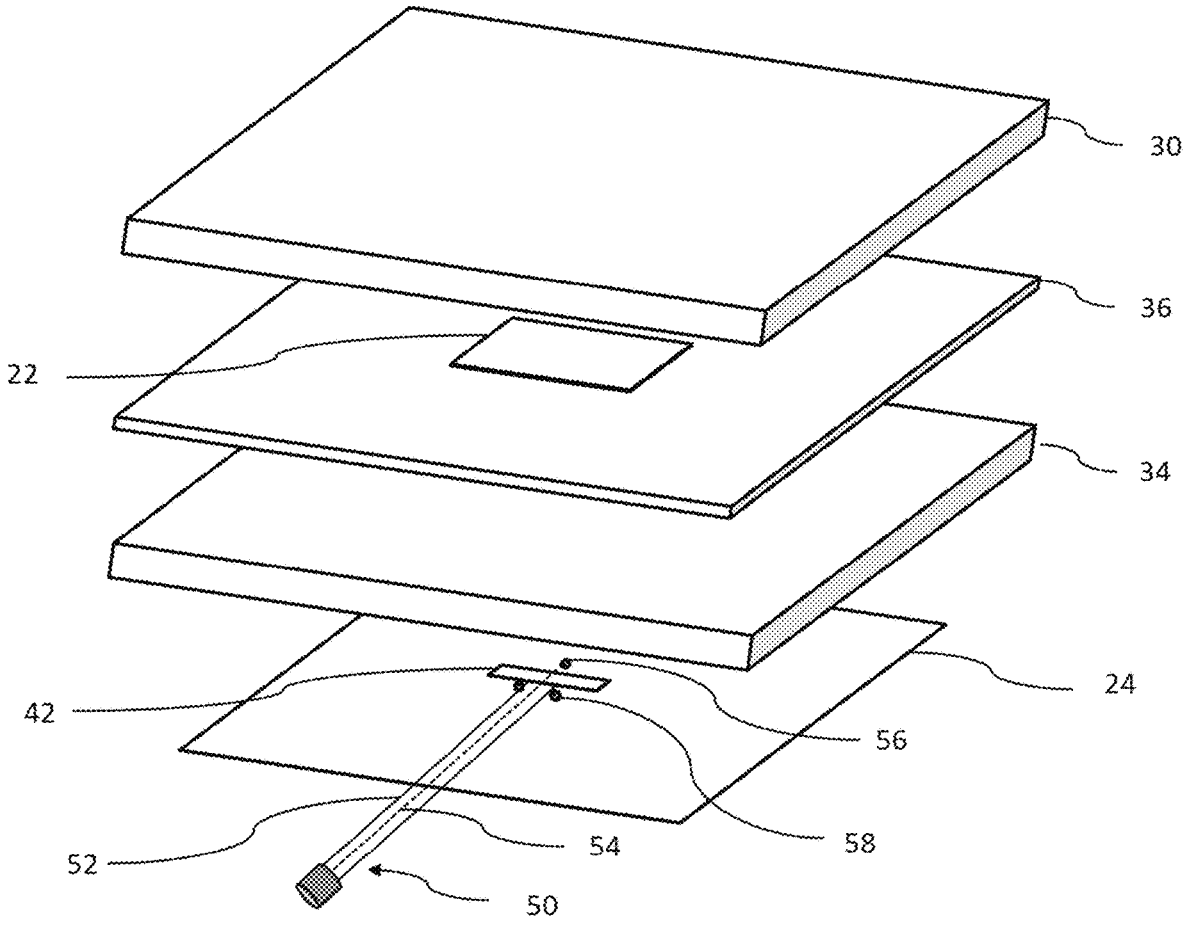
FIG. 4 is an exploded view of a second embodiment of a patch antenna in accordance with the presently disclosed invention.

An alternative preferred embodiment is shown in FIG. 4. In the embodiment of FIG. 4, the patch antenna is fed directly through coupling slot 42 using a coaxial cable 50 that has a center conductor 54 and an outer shield 52. Center conductor 54 extends over slot 42 and is galvanically connected to the furthest side of slot 42 at a solder pad 56 on second conductive layer 24. Outer shield 52 is galvanically connected to the near side of slot 42 at a solder pad 58 on second conductive layer 24. Coaxial cable 50 and slot 42 transmit electromagnetic energy to first conductive layer 22 and receives electromagnetic energy from first conductive layer 22. An advantage of the presently disclosed invention is that it combines advantageous electrical characteristics of the antenna with physical component parts such that the antenna may be more readily incorporated in current windshield designs or other transparency designs using existing manufacturing processes. Another advantage of the presently disclosed antenna is that it is more easily and conveniently connected by conductive connections to electronic circuitry that is external to the antenna.

Figures 7, 8:
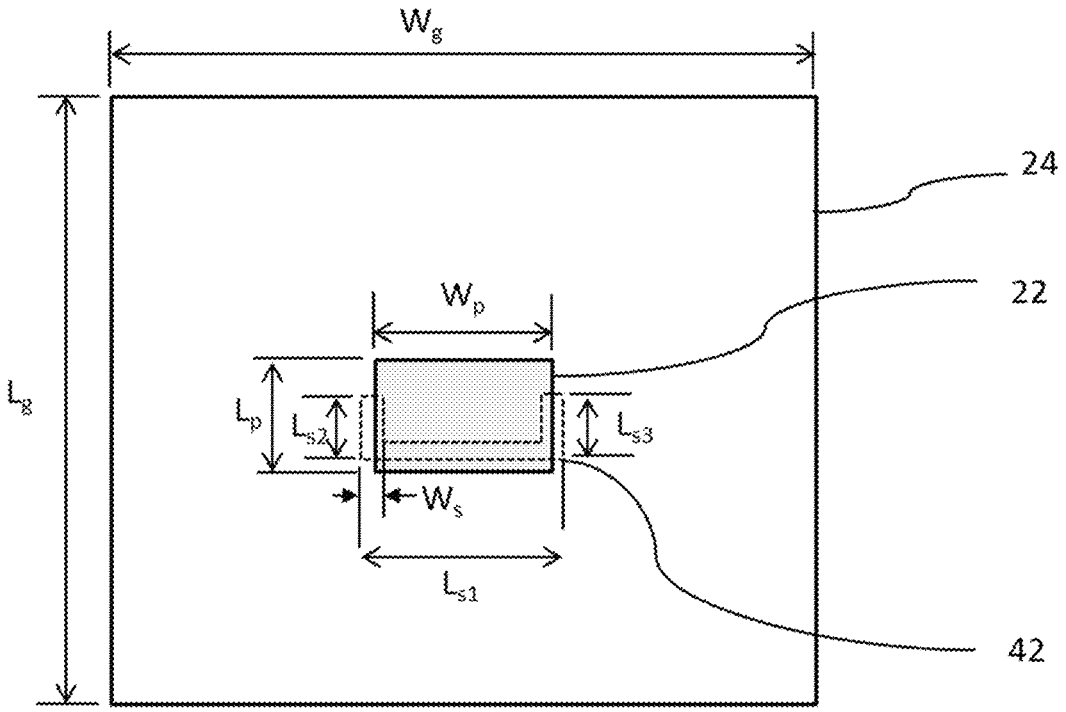
FIG. 7 is a plan view identifying selected dimensions of a preferred embodiment of the disclosed invention.
FIG. 8 is a table that lists the dimensions of the preferred embodiment of the invention identified in FIG. 7.

FIG. 7 illustrates another preferred patch antenna and includes illustrative dimensions for the embodiment. First conductive layer 22, second conductive layer 24, and slot 42 are all relatively sized according to the dimensions listed in FIG. 8. The length Lp of first conductive layer 22 determines the resonant frequency of the patch antenna. The width Wp of first conductive layer 22 affects the resonant resistance of the patch antenna, with a wider patch producing a lower resistance. The patch antenna coupling level is primarily determined by the total length Ls=Ls1+Ls2+Ls3 of the U-shaped coupling slot 42, as well as the back-radiation level. Therefore, slot 42 should be no longer than is required for impedance matching. The width Ws of slot 42 also affects the coupling level, but to a much less degree than slot length Ls. A preferred ratio of slot width (Ws) to length (Ls) is typically 1/10.

Figure 9:
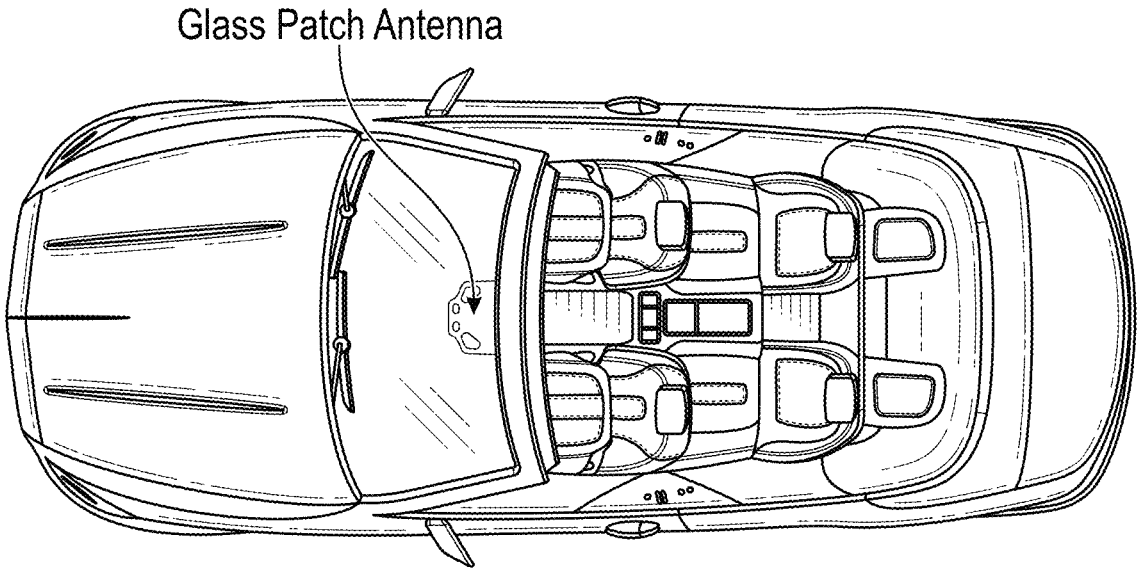
FIG. 9 is a top view of a vehicle having an antenna embodying the presently disclosed invention formed in its windshield.
Figure 10:
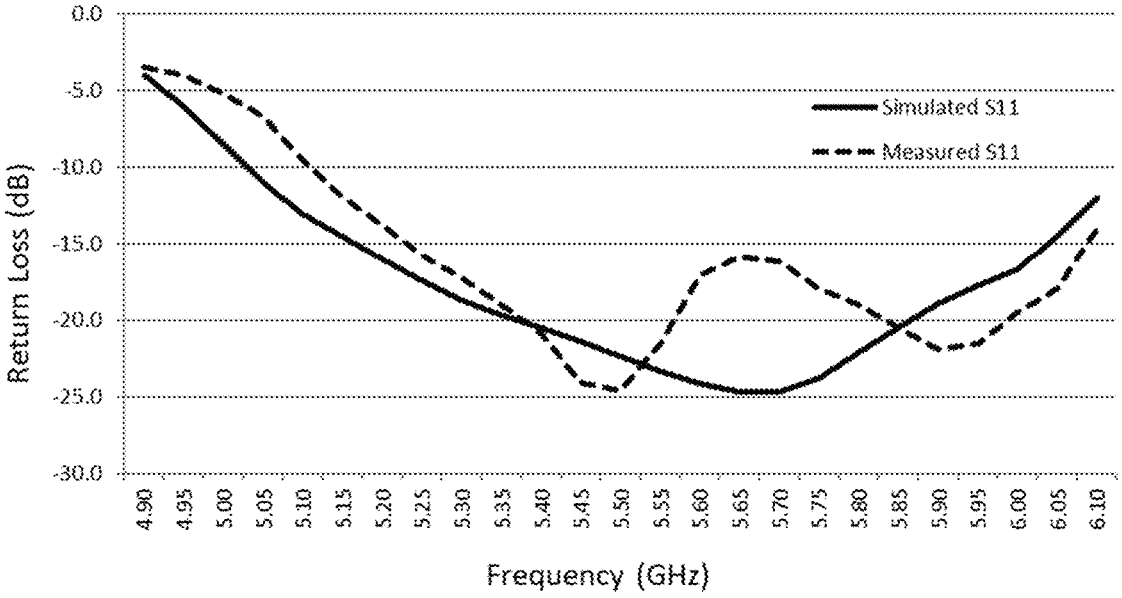
FIG. 10 is a graph illustrating simulated and measured frequency response of the antenna shown in FIG. 7-9 embodying the disclosed invention.

An embodiment of the patch antenna shown in FIGS. 4-7 with dimensions specified in FIG. 8 was fabricated on a windshield for a convertible car as pictured in FIG. 9. The patch antenna is located in the bottom of the third visor area of the windshield. FIG. 10 is a plot of the return loss (S11) comparison between the actual measured results and the simulation results obtained using the FEKO simulation tool. Of the power delivered to the antenna, return loss S11 is a measure of how much power is reflected from the antenna and how much is "accepted" by the antenna and radiated. FIG. 10 shows that the return loss is below −10 dB in the frequency range from 5.1 to 6.1 GHz. This means that the antenna can be used in UNIT, ISM, IEEE 802.11a and 802.11ac, Radio Local Area Networks (RLAN), Fixed Wireless Access Systems (FWA), WiMAX and MESH wireless networks from 5.18 to 5.85 GHz as well as DSRC band of 5.85 to 5.925 GHz.

Figure 11:
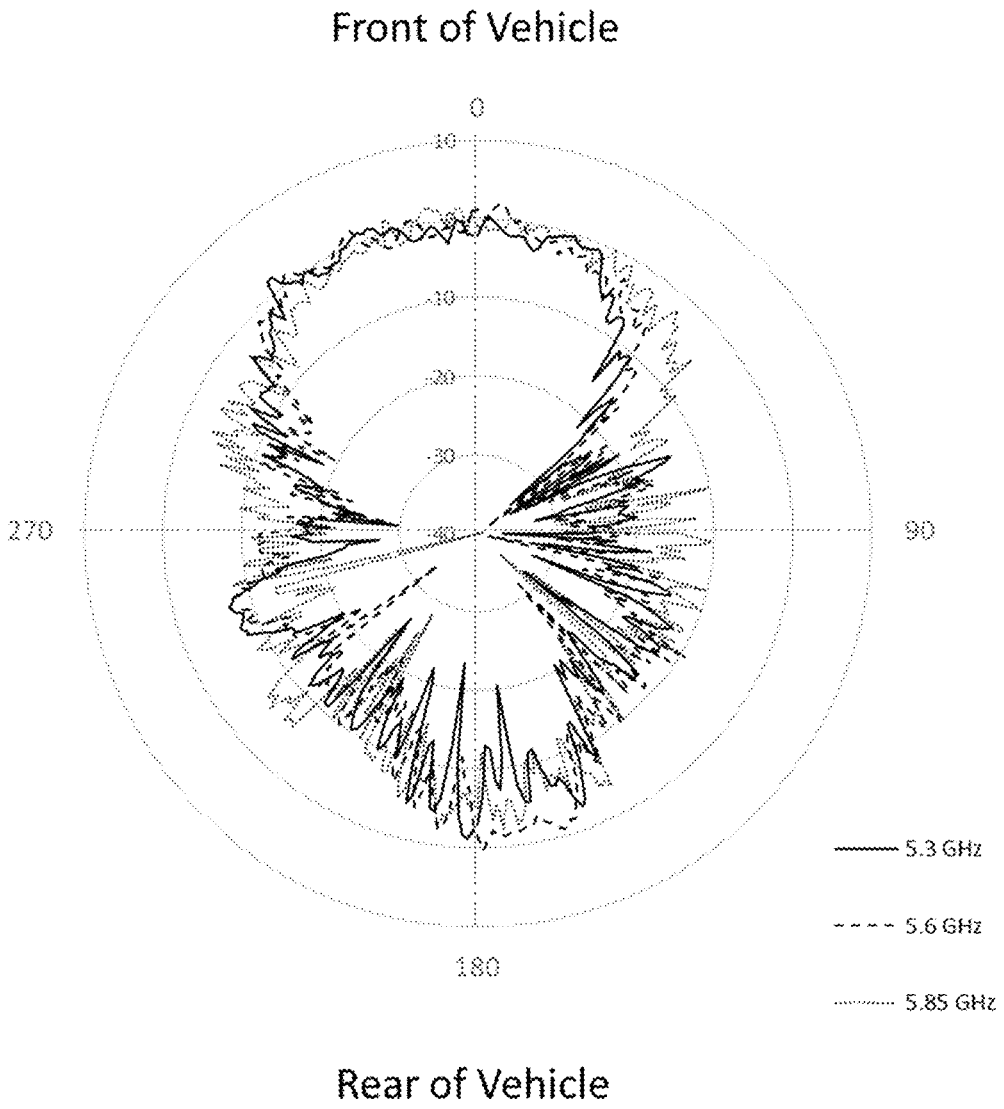
FIG. 11 is a graph illustrating vertical gain pattern of the disclosed patch antenna taken at 5 GHz Wi-Fi and DSRC frequencies and at −5° elevation angle.

The vehicle antenna gain pattern was measured on an outdoor antenna range. FIG. 11 shows the vehicle antenna radiation pattern for vertical polarization at frequencies of 5.3 GHz, 5.6 GHz and 5.85 GHz respectively. The elevation angle is −5°. The patch antenna maximum gain is about 0 dBi and directed to the front of the vehicle. The half power beam width in the azimuth plane is about 70°.

Figure 12:
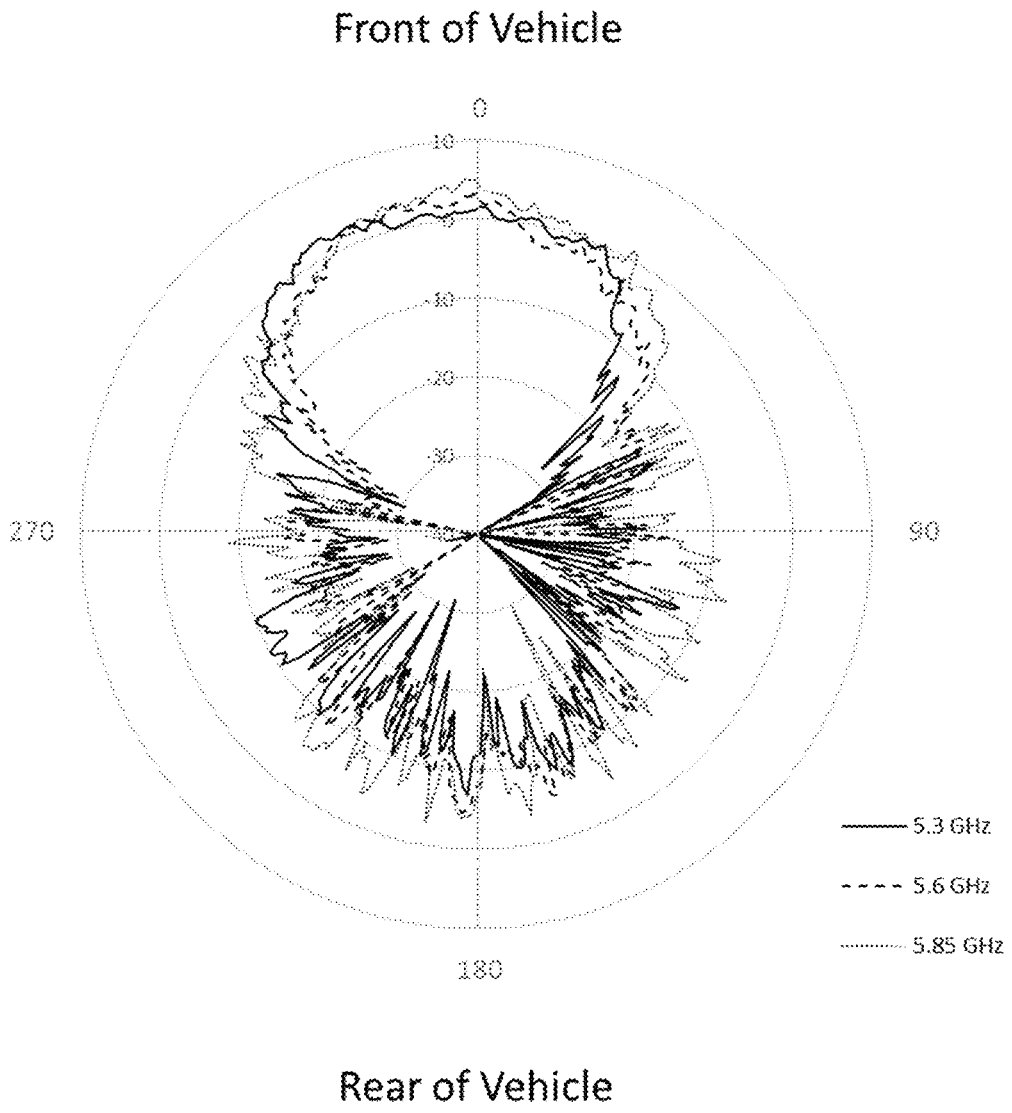
FIG. 12 is a graph illustrating vertical gain pattern of the disclosed patch antenna at 5 GHz Wi-Fi and DSRC frequencies and at 0° elevation angle.

FIG. 12 shows the vehicle antenna radiation pattern for vertical polarization at elevation angle 0°. The patch antenna maximum gain is about 3 dBi and directed to the front of the vehicle. For a patch antenna that is embedded in the windshield, higher elevation angle is more toward the broadside of the patch antenna with maximum gain, therefore, only measurement data at 0° and −5° elevation angles are shown. The antenna gain and beam width also depend on the angle of the windshield on a vehicle. The antenna would perform better on a vertical windshield than on a windshield that is more inclined away from a vertical plane. The windshield antenna provides better coverage in the forward-facing vehicle direction than in the backward or side directions.

The antenna can be embedded in the windshield, the back window and the side windows for a diversity system with omnidirectional far field radiation pattern in terrestrial direction.

While several preferred embodiments of the presently disclosed invention have been shown and described herein, those skilled in the art will recognize various modifications that may be adopted without departing from the spirit of the disclosed invention as set forth in the following claims.

What is claimed is:

1. A glazing that includes a patch antenna, said glazing comprising:

an inner transparent ply that has first and second oppositely disposed surfaces;

an outer transparent ply that has first and second oppositely disposed surfaces;

an interlayer that is located between the first surface of said inner transparent ply and the second surface of said outer transparent ply;

a first conductive layer that defines an outer perimeter edge, said first conductive layer being located between said second surface of said outer transparent ply and said interlayer;

a second conductive layer that is located on the second surface of said inner transparent ply, said second conductive layer defining an outer perimeter edge and also defining a slot that is L-shaped, or U-shaped, said slot being laterally aligned with respect to said first conductive layer such that the center of said slot is aligned with the center of said first conductive layer, said slot having a total length equal to one half wavelength at the fundamental TE10 frequency mode, said slot being located inside the outer perimeter edge of said second conductive layer, said second conductive layer being laterally aligned with respect to said first conductive layer such that the outer perimeter edge of said first conductive layer aligns inside the outer perimeter edge of said second conductive layer and also such that said slot aligns inside the outer perimeter edge of said first conductive layer, said slot is spaced apart from said first conductive layer such that electrical signals applied to the edges of said slot are electromagnetically coupled to said first conductive layer.

2. The glazing of claim 1 wherein said first conductive layer is the main radiating element of said patch antenna.

3. The glazing of claim 2 wherein said second conductive layer is the electrical ground element of said patch antenna.

4. The glazing of claim 2 wherein said interlayer and said inner transparent ply form a dielectric substrate for said patch antenna.

5. The glazing of claim 2 wherein the bandwidth of said patch antenna covers WI-FI under IEEE 802.11a/ac standard from 5.18 to 5.85 GHz and the DSRC band of 5.85 to 5.925 GHz.

6. The glazing of claim 2 wherein said patch antenna is fed by a microstrip line that is etched on a substrate that is located on the second side of said inner transparency ply.

7. The glazing of claim 6 wherein said patch antenna is excited through two coupling stages, one coupling stage between said microstrip line and said slot and another coupling stage between said slot and said first conductive layer.

8. The glazing of claim 7 wherein the characteristic impedance of said microstrip line and the width of said microstrip line affect the coupling with said slot.

9. The glazing of claim 7 wherein said microstrip line is oriented at right angles to the centerline of said slot.

10. The glazing of claim 2 wherein said patch antenna is embedded in a windshield, a back window, or a side window to produce a diversity antenna system having an omnidirectional far field radiation pattern in terrestrial direction.

11. The glazing of claim 1 wherein the maximum electromagnetic field in said slot occurs in the center of said slot and wherein the maximum magnetic field of said first conductive layer occurs in the center of said first conductive layer.

12. The glazing of claim 1 wherein energy is electromagnetically coupled between the slot and said first conductive layer.

13. The glazing of claim 1 wherein said slot supports a set of orthogonally oriented even and odd modes.

14. The glazing of claim 13 wherein said odd modes have a maximum field strength that occurs at the center of said slot.

15. The glazing of claim 1 wherein said patch antenna includes a coaxial cable having a center conductor that is surrounded by an outer shield with the outer shield of said coaxial cable being connected to one side of said slot and the center conductor of said coaxial cable being connected to the opposite side of said slot.

16. The glazing of claim 15 wherein said coaxial cable and said slot transmit electromagnetic energy to said first conductive layer and receive electromagnetic energy from said first conductive layer.

17. The glazing of claim 1 wherein the length of said first conductive layer determines the resonant frequency of said patch antenna and the width of said first conductive layer affects the resonant resistance of said patch antenna.

18. The glazing of claim 1 wherein the length of said slot determines the coupling level and the back radiation level of said patch antenna.

* * * * *